US005433162A

United States Patent [19]

Shigematsu et al.

[11] Patent Number: 5,433,162

[45] Date of Patent: Jul. 18, 1995

[54] APPARATUS FOR REDUCING ROCKING MOTION OF MARINE FLOATING STRUCTURE

[75] Inventors: Shozo Shigematsu, Yokohama; Masao Mutaguchi, Yotsukaido, both of Japan

[73] Assignee: Ishikawajima-Harima Jukogyo Kabushiki Kaisha, Tokyo, Japan

[21] Appl. No.: 82,497

[22] Filed: Jun. 28, 1993

[30] Foreign Application Priority Data

Dec. 18, 1992 [JP] Japan ..... 4-354877

[51] Int. Cl.[6] ..... B63B 39/02

[52] U.S. Cl. ..... 114/124

[58] Field of Search ..... 114/121, 124; 180/167, 180/168; 104/281, 282, 283; 52/167 R, 167 DF

[56] References Cited

U.S. PATENT DOCUMENTS 57,834 9/1866 Winans et al. ..... 114/124
3,809,000 5/1974 Horsford et al. ..... 114/124
3,858,522 1/1975 Maki ..... 104/282
4,793,263 12/1988 Basic et al. ..... 104/282
5,182,887 2/1993 Uno et al. .

FOREIGN PATENT DOCUMENTS 309771 7/1933 Italy ..... 114/124

*Primary Examiner*—Stephen P. Avila
*Attorney, Agent, or Firm*—Oblon, Spivak, McClelland, Maier & Neustadt

[57] ABSTRACT

A linear motor has a stator body securely attached to a marine floating structure and a movable body acting as solid mass. In response to a command signal from a controller which phase-controls a signal from rocking-motion sensor, the movable body is forced to move in a direction of reducing the rocking motion against the floating structure in rocking motion, so that the rocking motion of the marine floating structure is reduced or suppressed.

1 Claim, 6 Drawing Sheets

APPARATUS FOR REDUCING ROCKING MOTION OF MARINE FLOATING STRUCTURE

BACKGROUND OF THE INVENTION

The present invention relates to an apparatus for reducing or suppressing rocking motion such as rolling and pitching of a marine floating structure such as ship or barge.

Known apparatuses of this kind are an anti-rolling tank and a fin stabilizer. In an anti-rolling tank as schematically shown in FIG. 1, which is used to suppress rolling of a ship, a U-shaped water tank c with its upper ends being intercommunicated through an air pipe b is arranged in a main hull a on a deck above a center of gravity of the hull. It is designed such that in response to rolling of the hull a, water d in the tank c is caused to make passive resonance which lags in phase by 90° to the rolling.

A fin stabilizer schematically shown in FIG. 2 comprises movable fins f which are driven by drives e and which are attached to a submerged bilge of a main hull a substantially at a mid-point thereof in a fore-and-aft direction. An angle of rolling, an angular velocity and an angular acceleration of the main hull a are detected by a sensor g and an angle of elevation of each fin f is actively varied in response to the detected values so that the rolling of the main hull a is suppressed by dynamic lift produced on the fins f according to a velocity of the ship.

An anti-rocking system using solid mass as shown in FIG. 3 has been also proposed in which a base h with rails i is mounted on a bottom, deck or the like of a main hull a and a weight k as solid mass rides through wheels j on the rails i. A lead-screw 1 threadably extends through the weight k and is supported at its opposite ends by bearings m. One end of the lead-screw 1 is connected through a coupling p to a reduction gear n and a motor o. When the main hull a rocks, the motor n is rotated in a clockwise or counterclockwise direction so that the weight k is displaced in a direction opposite to that of an external force acting on the hull a so as to reduce the rolling motion of the hull a.

The anti-rolling tank has the following problems:

(1) Since a required whole weight of the tank is generally 3 or 4% of a displacement of the hull in the case of a smaller vessel and 1 or 2% in the case of a larger vessel and since the anti-rolling mass is water, the system requires a large space over the upper deck, resulting in bad after-visibility in steering.

(2) In a smaller ship, performance of the ship is adversely affected by the raised center of gravity.

(3) An anti-rolling effect may be comparatively satisfactory in a ship in waves. But, when the waters are calm, free water increases so that an angle of list or heel of the ship is increased.

(4) Once designed, the anti-rolling tank has a predetermined natural period so that when an actual rolling period of a ship is different from that of the anti-rolling tank designed, the anti-rolling effect is reduced.

(5) Noise is produced in response to flow of the water and associated flow of the air through the intercommunicating pipe so that environmental conditions such as comfortability are adversely affected.

The fin stabilizer has the following problems.

(1) The anti-rolling effect cannot be ensured until the velocity of the ship becomes in excess of a certain level at which the fins produce dynamic lift. In other words, the anti-rolling effect is not expected when the ship moves at a low velocity or when the ship stops.

(2) Rigging of the fin stabilizer to the hull is very complicated.

(3) As compared with the anti-rolling tank, the fin stabilizer is very expensive (about five times as much as that of the anti-rolling tank).

(4) There exists a fear that the noise produced by the fin stabilizer adversely affects functions of sonar equipment.

(5) Since the fin stabilizer is attached to the hull, the velocity of the ship is slowed.

In the case of the anti-rocking system utilizing solid mass, a drive includes a rotating body so that in order to linearly drive a driven body, an auxiliary system is required comprising gears and a screw (or a linkage). As a result, the construction becomes complicated and system failure frequently happens and consequently maintenance becomes cumbersome. In addition, the whole weight of the system becomes very heavy.

In view of the above, the present invention has for its object to provide an apparatus for reducing rocking motion of a marine floating structure, which is simple in construction and light in weight, by overcoming the above-mentioned problems encountered in the anti-rolling tank, the fin stabilizer and the anti-rocking system using solid mass.

In order to overcome the above-mentioned problems, an apparatus for reducing rocking motion of a marine floating structure in accordance with the present invention comprises a linear motor with stator means and movable means, said stator means being securely attached to the marine floating structure, said movable means serving as solid mass, a rocking-motion sensor for detecting rocking motion of said marine floating structure and a controller for phase-controlling a signal from said rocking-motion sensor to transmit a driving command to said linear motor.

When the rocking motion of the marine floating structure is detected by the rocking-motion sensor, a signal therefrom is phase-controlled by the controller and is outputted to the linear motor. In response to the received signal, the movable means is forced to move in a direction of reducing rocking motion against the marine floating structure in rocking motion so that the movable means of the linear motor acts as solid mass to reduce the rocking motion of the marine floating structure.

The present invention will become more apparent from the following description of preferred embodiments thereof taken in conjunction with the accompanying drawings.

DETAILED DESCRIPTION OF THE PREFERRED EMBODIMENTS

Figure 1:
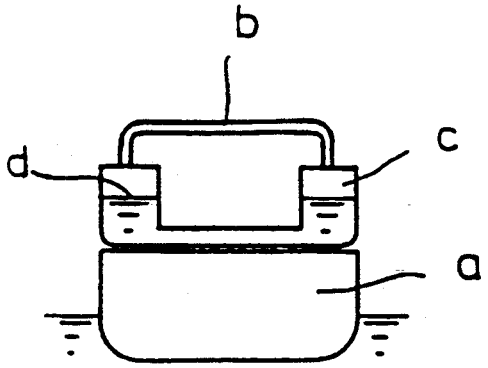
Fig.1 PRIOR ART
FIG. 1 is a schematic view illustrating a conventional anti-rolling tank.
Figure 2:
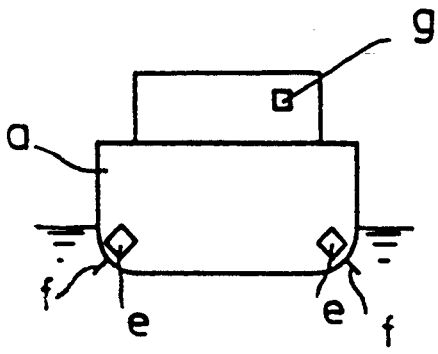
Fig.2 PRIOR ART
FIG. 2 is a schematic view illustrating a conventional fin stabilizer.
Figure 3:
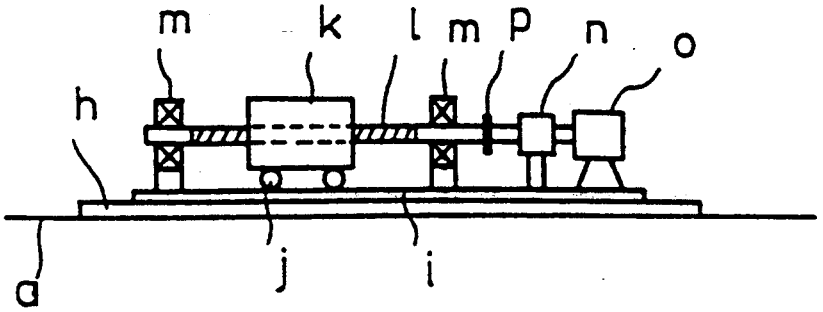
Fig.3 PRIOR ART
FIG. 3 is a schematic view illustrating a conventional anti-rocking system using solid mass.
Figure 4A:
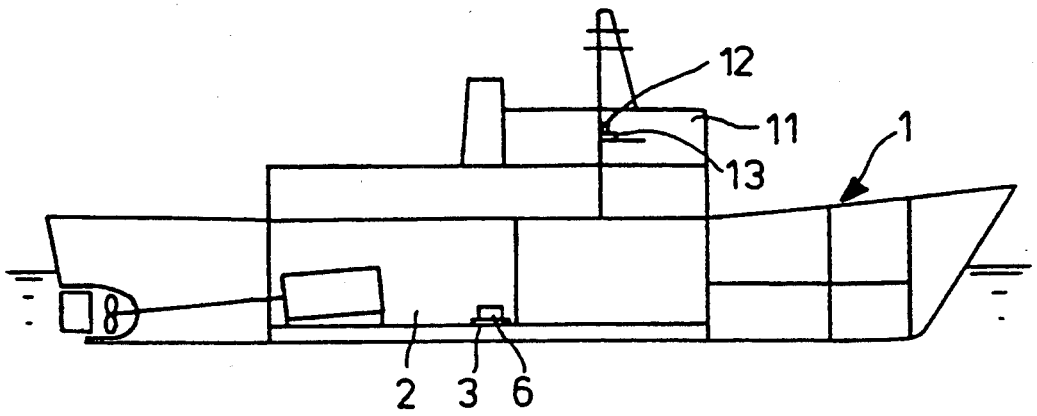
FIG. 4A is a side view of a ship with a first preferred embodiment of an apparatus for reducing rocking motion of a marine floating structure in accordance with the present invention.
Figure 4B:
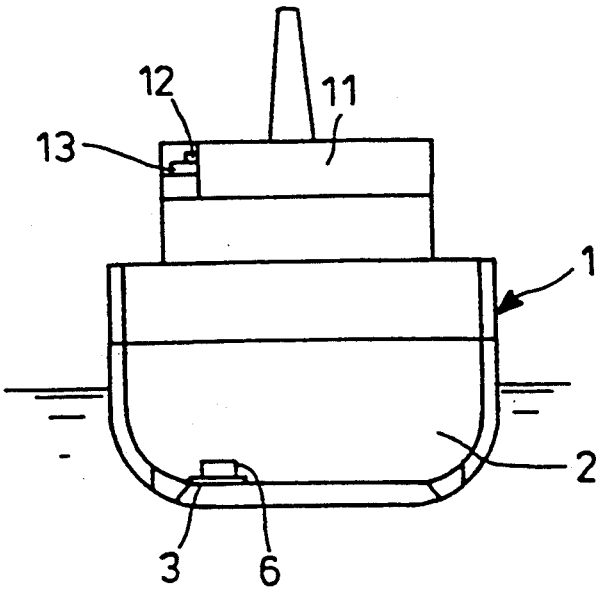
FIG. 4B is a cross sectional view thereof.

In a first embodiment of the present invention shown in FIGS. 4A to 7, a marine floating structure is a ship generally indicated by a reference numeral 1. A base 3 is mounted on a bottom floor of an engine room 2 and a pair of parallel guide rails 7 are laid on the base 3. A linear motor 6 comprises a movable means or body 4 and a stator means or body 5. The movable body 4 rides through wheels 8 on the rails 7 while the stator body 5 is securely arranged between the rails 7 in parallel therewith such that a top of the stator body 5 is spaced apart from a bottom of the movable body 4. The stator body 5 is electrically connected to an excitation power supply (not shown) and the movable body 4 is electrically connected to a variable drive power supply 15 (See FIG. 7) so that when the electric current is supplied to the movable body 4, dielectric electromotive force is produced between the bodies 4 and 5 and consequently the movable body 4 is forced to linearly move as solid mass along the stator body 5.

Figure 6:
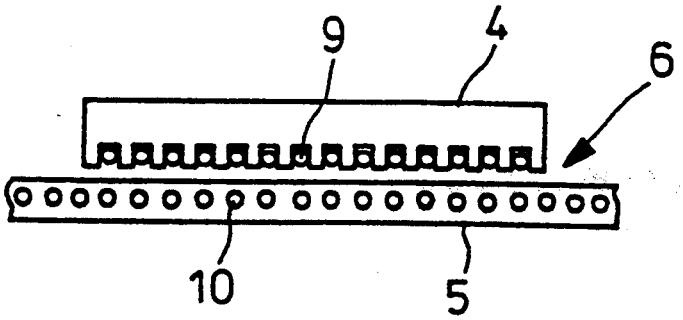
FIG. 6 is a view, on an enlarged scale, of a linear motor.

As best shown in FIG. 6, the linear motor 6 comprises the movable body 4 consisting of a primary core with three-phase windings 9 and the stator body 5 consisting of a secondary core with squirrel-cage windings 10. The movable body 4 is located on one side of the stator body 5.

Figure 7:
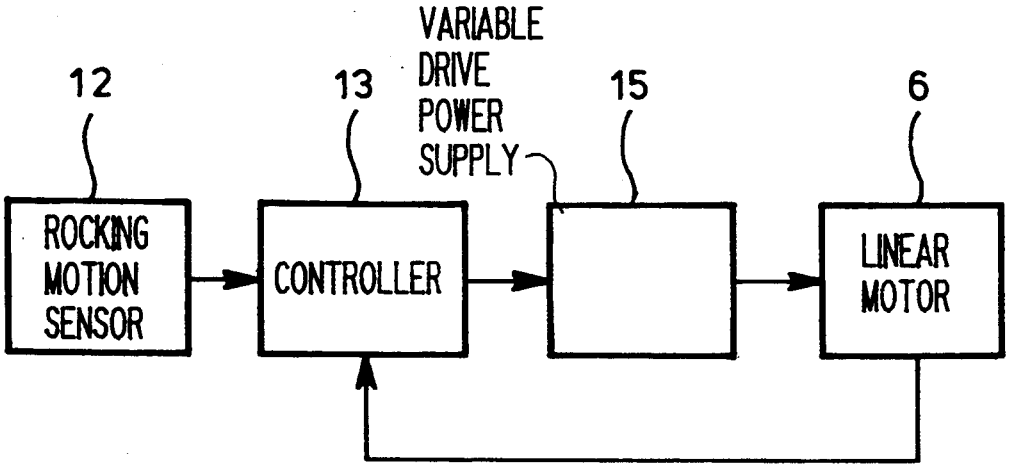
FIG. 7 is a block diagram of a linear motor control system.

A rocking-motion sensor 12 and a controller 13 are located in a wheelhouse 11 of the ship 1. The variable drive power supply 15 of the movable body 4 is energized by a control signal generated and delivered from the controller 13 in response to a signal from the rocking-motion sensor 12 so that any displacement of the movable body 4 is controlled in relation to the rocking motion of the ship 1 and consequently the energy of rocking motion of the ship 1 is consumed or absorbed. As shown in FIG. 7, the controller 13 processes the rocking-motion signal from the rocking-motion sensor 12 and delivers to the power supply 15 a phase and displacement signal which lags in phase by 90° with respect to the rocking motion of the ship 1. The displacement signal applied to the movable body 4 is also fed back to the controller 13. Instead of installing the rocking-motion sensor 12 in the wheelhouse 11, it may be located at any other suitable place. In the first embodiment, the rocking-motion sensor 12 comprises an acceleration sensor and the acceleration is integrated twice in the controller 13 to generate the displacement signal, but it is possible to integrate the degree of acceleration only one time to generate a velocity signal which in turn is converted into a reversed signal to be applied to the movable body 4 as displacement signal.

To make an electric current flow through the primary core or the movable body 4 of the linear motor 6 causes the dielectric electromotive power to be produced between the movable body 4 and the stator body 5 so that the movable body 4 is forced to move along the guide rails 7. Therefore, when the rocking motion of the ship 1 is detected by the rocking-motion sensor 12, a phase-controlled control signal based on a signal from the sensor 12 is transmitted from the controller 13 to the variable drive power supply of the movable body 4 so that the movable body 4 is forced to move in a direction of reducing the rocking motion in relation to external force acting on the ship 1 and the movable body 4 functions as solid mass to immediately suppress the rocking motion of the ship 1. The movement of the movable body 4 can be controlled by phase-controlling the multi-phase alternating current and the velocity and acceleration can be controlled by changing the frequency.

In the first embodiment, the movable body 4 which is a component part of the linear motor 6 is used as solid mass for reducing a ship's rocking motion so that the linear displacement of the solid mass or movable body 4 can be effected by the mechanism simple in construction without using gears, lead screws and so on.

Figure 5A:
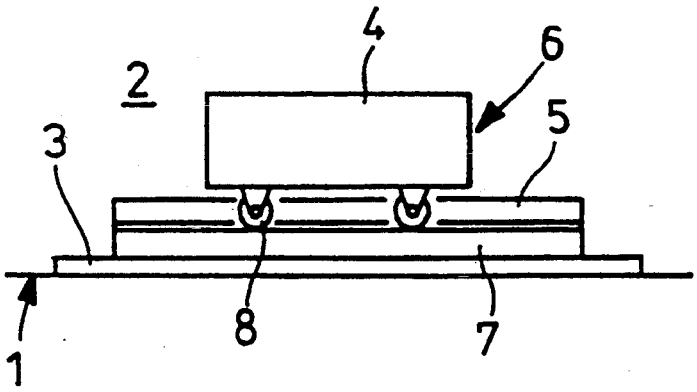
FIG. 5A is a side view of the apparatus for reducing rocking motion of a marine floating structure shown in FIGS. 4A and 4B.
Figure 5B:
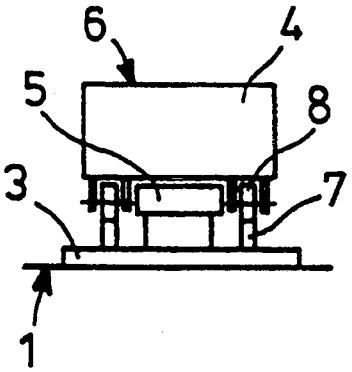
FIG. 5B is a front view thereof.
Figure 8A:
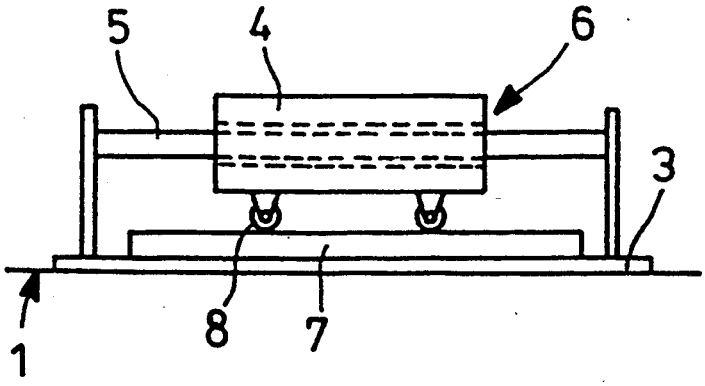
FIG. 8A is a side view of a second embodiment of the present invention
Figure 8B:
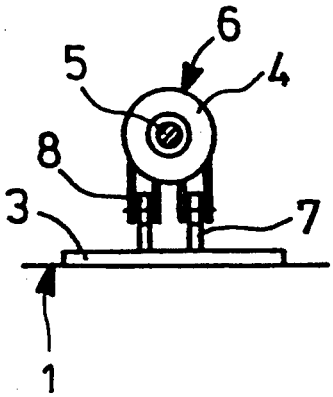
FIG. 8B is a front view thereof.

A second embodiment shown in FIGS. 8A and 8B is similar in construction to the first embodiment shown in FIG. 5 except that the linear motor 6 is in the form of cylinder. More specifically, the movable body 4 as solid mass is a hollow cylinder through which a rod-like stator body 5 extends for movement of the movable body 4. Opposite ends of the stator body 5 are secured in position.

The second embodiment can also attain meritorious functions and effects similar to those of the first embodiment described above.

Figure 9:
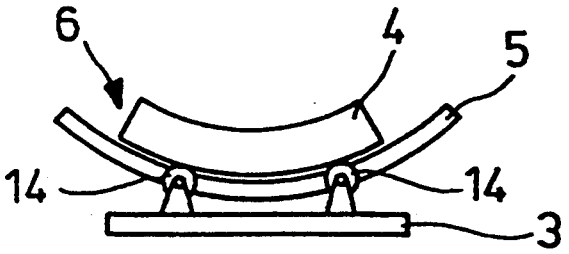
FIG. 9 is a schematic view of a third embodiment of the present invention.
Figure 10:
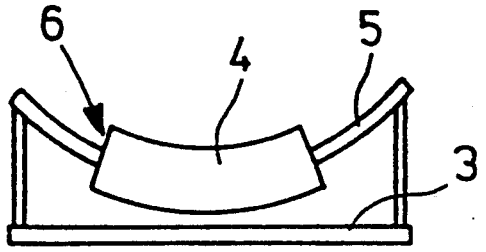
FIG. 10 is a schematic view of a fourth embodiment of the present invention.

FIGS. 9 and 10 illustrate third and fourth embodiments of the present invention which are modifications of the first and second embodiments described above with reference to FIGS. 5 and 8A and 8B, respectively. In the third embodiment shown in FIG. 9, the movable body 4 and the stator body 5 of a one-sided linear motor 6 are in the form of an arc and are arranged in concentric relationship with each other. The movable body 4 is supported by support rollers 14 which are spaced apart from each other along the length of the stator body 5. In the fourth embodiment shown in FIG. 10, the cylindrical linear motor 6 is constructed in the form of an arc.

In both the third and fourth embodiments, the movable body 4 is forced to swing like a pendulum (in single harmonic oscillation), thereby suppressing the rocking motion of a ship.

To synchronize a natural period of the movable body 4 with that of the hull enables the movable body 4 to act as passive means to reduce any rocking motion of the ship without operating the variable drive power supply at synchronous or resonance point of the rocking.

Figure 11:
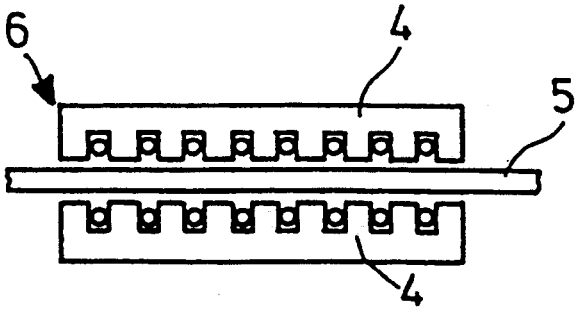
FIG. 11 is a sectional view, on an enlarged scale, illustrating the construction of another linear motor.

So far in the above embodiments, it has been described that the apparatus is arranged along width of a ship so as to reduce rolling of a ship; but when the apparatus is arranged along the length of the ship, pitching of the ship 1 can be reduced. For instance, when one apparatus is arranged in the widthwise direction of a ship while another is arranged in a lengthwise direction or when two apparatuses are arranged in the lengthwise and widthwise directions of a ship such that they are perpendicular with each other, both rolling and pitching can be reduced. In the first, second and third embodiments, the one side or unilateral type linear motor is used, but it is to be understood that the present invention may have a two-side or bilateral type linear motor as shown in FIG. 11. In this case, two movable bodies 4 can be arranged on opposite sides of the stator body 5. Furthermore, the movable body 4 may consist of a secondary core while the stator body 5, a primary core. It has been also described that the movable body 4 is provided with the wheels 8, but any mechanism may be employed such as linear guides, sliding bearings, magnetic force system, air pressure system, hydraulic floating system and so on which can permit displacement of the movable body 4. In the above-described embodiments, the rocking-motion reducing apparatus is disposed on a ship; but it is to be understood that the apparatus may be mounted in any marine floating structures. That is, various modifications may be effected without departing from the true spirit of the present invention.

As described above, in the apparatus for reducing rocking motion of a marine floating structure according to the present invention, the linear motor has movable and stator means. The movable means acts as solid mass while the stator means is securely mounted in a marine floating structure. In response to a signal from the rocking-motion sensor, the controller delivers a phase-controlled command signal to the linear motor. As a result, the present invention can offer the following advantages:

(1) Auxiliary system using gears, screws and so on can be eliminated and instead the linear motor is used such that its movable means acts as solid mass which makes reciprocating motion. As a result, the apparatus can immediately respond to rocking motion of a marine floating structure so that the rocking motion of the latter can be effectively reduced.

(2) Since solid mass is used, the apparatus installation space can be considerably reduced (about by less than $\frac{1}{3}$ as compared with the anti-rolling tank systems). Especially in the case of ships, the apparatus of the present invention may be disposed in the main hull. As a result, the steering operation can be improved; capability of righting the ship into upright position can be enhanced; and the space within the main hull can be advantageously utilized.

(3) The solid mass can be maintained at a predetermined position or can be displaced by the drive so that a marine floating structure can be prevented from listing in calm waters.

(4) The apparatus of the present invention can be designed compact in size, small in construction and inexpensive in cost. Because of a linear motor being used, friction can be minimized and the solid mass can be displaced by a comparatively low-power drive so that reduction in running cost can be effected.

(5) When a number of the apparatuses and installation positions thereof are suitably selected, rocking motion in any directions of a marine floating structure can be reduced. That is, a marine floating structure can be satisfactorily stabilized.

(6) Since gears, screws, linkages and so on can be eliminated, noise produced during operation of the apparatus can be remarkably suppressed.

What is claimed is:

1. An apparatus for reducing rocking motion of a marine floating structure comprising a linear motor including a stator and a movable member in the forms of downwardly curving arcs in concentric relation with each other, said stator member being securely attached to said floating structure, said movable member being a solid mass, a sensor for detecting rocking motion of said structure, a power supply, a controller for phase-controlling a signal from said sensor to deliver a driving command signal to said power supply to operate said linear motor, wherein said controller stops the operation of said linear motor and said power supply when the movement of said movable member is synchronized with the rocking motion of said structure whereby a natural period of said movable member thereafter causes said member to act passively to reduce rocking motion of said structure without operation of said power supply.

* * * * *